US008632738B2

(12) United States Patent
Giribona et al.

(10) Patent No.: US 8,632,738 B2
(45) Date of Patent: Jan. 21, 2014

(54) SYRINGE ACTUATING METHOD AND ASSEMBLY

(75) Inventors: Paolo Giribona, Trieste (IT); Walter Bianco, Trieste (IT); Michele Minisini, Trieste (IT); Garcia Gaspar de Viedma Santoro, Madrid (ES)

(73) Assignee: Health Robotics S.r.l, Bolzano (IT)

( * ) Notice: Subject to any disclaimer, the term of this patent is extended or adjusted under 35 U.S.C. 154(b) by 43 days.

(21) Appl. No.: 12/870,876

(22) Filed: Aug. 30, 2010

(65) Prior Publication Data

US 2012/0051971 A1 Mar. 1, 2012

(51) Int. Cl.
*B01L 3/02* (2006.01)

(52) U.S. Cl.
USPC ..... 422/546; 422/500; 422/501; 422/509; 422/518; 422/544; 422/560; 422/562; 422/566

(58) Field of Classification Search
USPC ..... 422/63, 500–501, 509, 518, 64–68.1, 422/520–526, 544, 546, 560–566; 141/27, 141/98; 222/180
See application file for complete search history.

(56) References Cited

U.S. PATENT DOCUMENTS 3,875,979 A * 4/1975 Hults ..... 141/27
4,187,890 A * 2/1980 Stach et al. ..... 141/27
4,316,558 A * 2/1982 Kubiak ..... 222/181.2
4,406,170 A * 9/1983 Kuhn ..... 73/864.16
4,429,724 A * 2/1984 Dorros et al. ..... 141/27
4,830,832 A * 5/1989 Arpagaus et al. ..... 422/65
4,998,570 A * 3/1991 Strong ..... 141/27
5,620,422 A * 4/1997 Halbich ..... 604/187
5,620,660 A * 4/1997 Belgardt et al. ..... 422/525
5,647,409 A * 7/1997 Christ et al. ..... 141/27
5,716,345 A * 2/1998 Halbich ..... 604/207
6,468,783 B1 * 10/2002 Leighton ..... 435/286.3
6,540,964 B2 * 4/2003 Kohrmann et al. ..... 422/501
6,740,295 B2 * 5/2004 Braun et al. ..... 422/501
6,841,129 B2 * 1/2005 Braun et al. ..... 422/518
7,128,105 B2 * 10/2006 Tribble et al. ..... 141/319
7,163,031 B2 * 1/2007 Graves et al. ..... 141/9
7,364,702 B2 * 4/2008 Hoffman et al. ..... 422/509
7,563,409 B2 * 7/2009 Suovaniemi et al. ..... 422/511
7,731,908 B2 * 6/2010 Lenz ..... 422/525
8,276,623 B2 * 10/2012 Van Vreeland et al. ..... 141/27
8,286,671 B1 * 10/2012 Strangis ..... 141/9
2001/0005490 A1 * 6/2001 Kohrmann et al. ..... 422/100
2001/0019701 A1 * 9/2001 Braun et al. ..... 422/63
2004/0197897 A1 * 10/2004 Leighton ..... 435/286.2
2010/0266454 A1 * 10/2010 Reichmuth ..... 422/100
2011/0088493 A1 * 4/2011 Blumentritt et al. ..... 73/864.17
2012/0003129 A1 * 1/2012 Rempt et al. ..... 422/501

* cited by examiner

*Primary Examiner* — Brian R Gordon
(74) *Attorney, Agent, or Firm* — McCarter & English, LLP

(57) ABSTRACT

A syringe, defined by a cylinder and by a piston slidingly engaged in the cylinder itself, is actuated after having inserted the cylinder within a gripper and having axially fed the syringe through the gripper so as to move an outer flange of the cylinder into contact with the gripper and/or the piston in a stop position within the cylinder.

18 Claims, 13 Drawing Sheets

SYRINGE ACTUATING METHOD AND ASSEMBLY

BACKGROUND OF THE INVENTION

The present invention relates to an actuating assembly of a syringe.

A machine is known in the pharmaceutical product preparation field comprising a store for storing syringes, each of which has a cylinder and a piston slidingly engaged in the cylinder itself; a store for storing bottles; a store for storing infusion bags; a dosing station for the preparation of a pharmaceutical product obtained by mixing at least one pharmaceutical substance contained in a bottle and at least one diluent contained in an infusion bag with one another; and a robotized gripping and transporting arm for transferring the syringes and the bottles between the dosing station and the respective stores.

Generally, the dosing station is provided with an actuating assembly comprising two gripping devices for the cylinder and for the piston of a syringe, respectively, and an actuating device for moving the two gripping devices with respect to one another in a direction parallel to a longitudinal axis of the syringe itself.

Since the syringe is first loaded into the respective store by an operator after having been extracted from a protective casing, and thus transferred to the actuating assembly by means of the robotized arm, the known actuating assemblies of the above-described type have several drawbacks, mainly deriving from the fact that such actuating assemblies cannot guarantee the correct initial position of the cylinder in the respective gripping device and the correct initial position of the piston along the cylinder itself, and may compromise the correct dosing of the pharmaceutical products in the syringes and/or in the infusion bags.

SUMMARY OF THE INVENTION

It is an object of the present invention to provide an actuating assembly of a syringe which is free from the above-described drawbacks and which is simple and cost-effective to be implemented.

According to the present invention, there is provided an actuating assembly of a syringe as claimed in the attached claims.

The present invention further relates to an actuating method of a syringe.

According to the present invention, there is provided an actuating method of a syringe as claimed in the attached claims.

BRIEF DESCRIPTION OF THE DRAWINGS

The present invention will now be described with reference to the accompanying drawings, which illustrate a non-limitative embodiment thereof, in which.

DETAILED DESCRIPTION OF THE INVENTION

Figure 1:
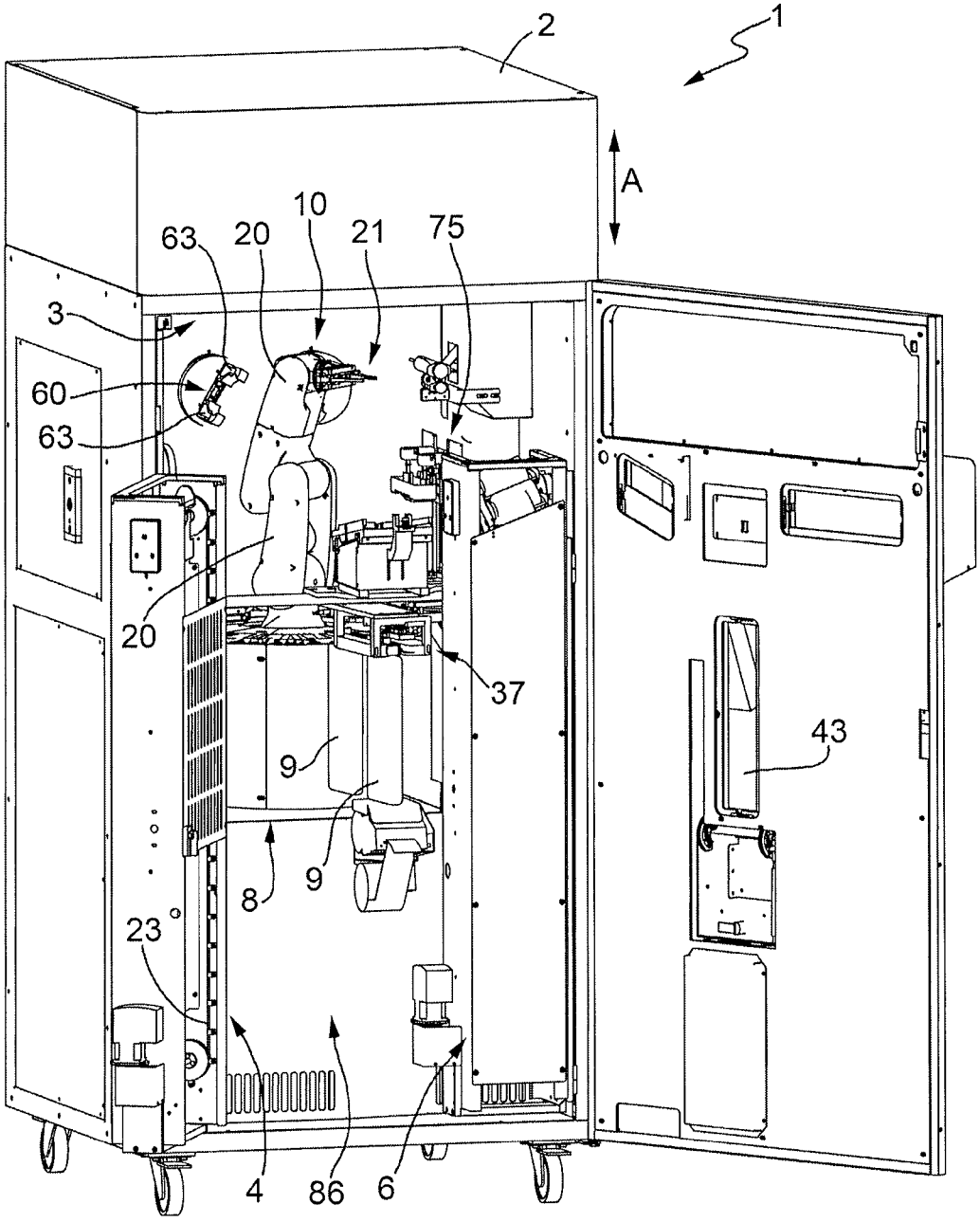
FIG. 1 is a diagrammatic perspective view, with parts removed for clarity, of a preferred embodiment of the machine according to the present invention.

With reference to FIG. 1, numeral 1 indicates as a whole a machine for the preparation of pharmaceutical products comprising a substantially parallelepiped containment box-like frame 2 defining an inner chamber 3, which is maintained in substantially sterile conditions by a pneumatic device of known type, shaped so as to feed a flow of sterile air through the chamber 3 and prevent the introduction of air from the external environment into the chamber 3.

The chamber 3 accommodates therein a store 4 for storing syringes 5; a store 6 for storing bottles 7; an annular store 8 for storing infusion bags 9; and a robotized gripping and transporting device 10 of the syringes 5 and/or of the bottles 7.

Each syringe 5 (FIG. 3) has a longitudinal axis 11, and comprises a cylinder 12 provided with an end flange 13 orthogonal to axis 11, a needle (not shown) coupled to the cylinder 12, a closing cap 14 mounted to protect the needle (not shown) from possible contaminations, and a piston 15, which is slidingly engaged in the cylinder 12, and is provided with an end head 16 perpendicular to axis 11.

Figure 5:
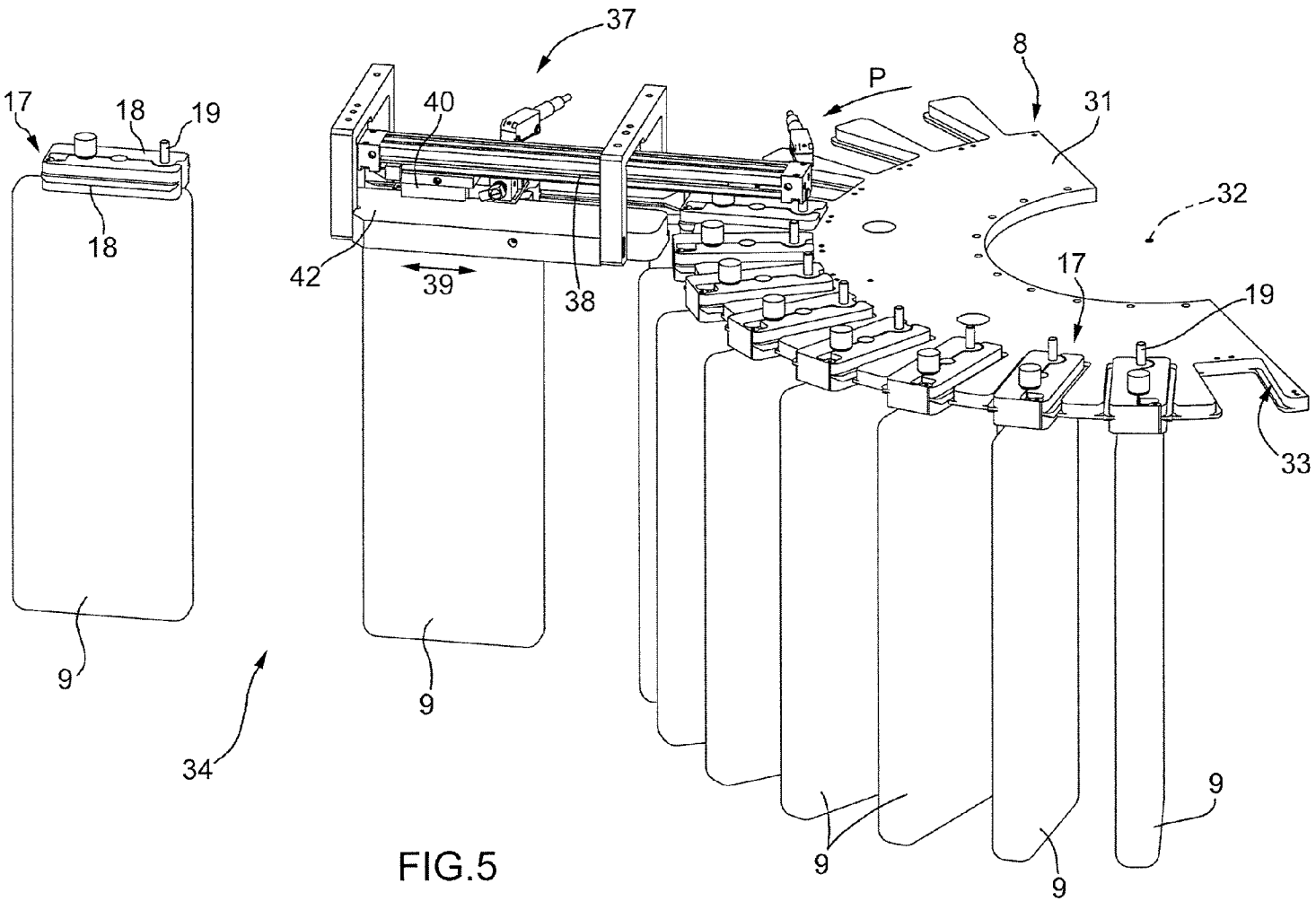
FIG. 5 is a diagrammatic perspective view, with parts removed for clarity, of a third detail of the machine in FIG. 1.

Each bag 9 is provided with an adapter member 17 of known type, which comprises two shaped jaws 18, mobile between a clamping position and a releasing position of an upper edge of the bag 9, and has a drawing pin 19 protruding upwards from one of the jaws 18 (FIG. 5).

Figure 3:
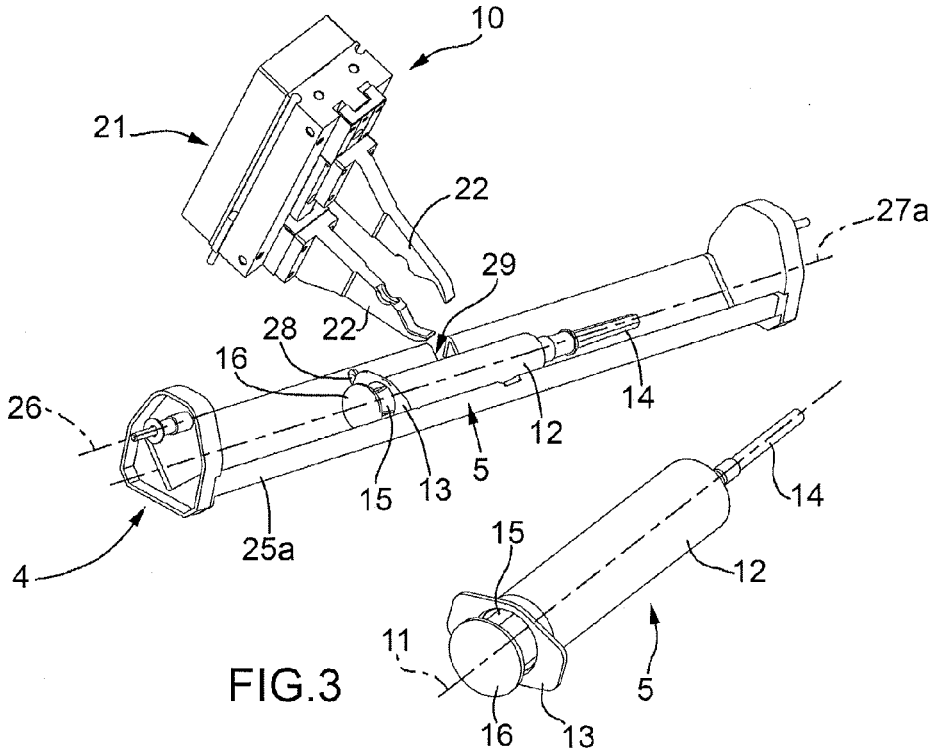
FIG. 3 is a diagrammatic perspective view, with parts removed for clarity, of a detail in FIG. 2.
Figure 4:
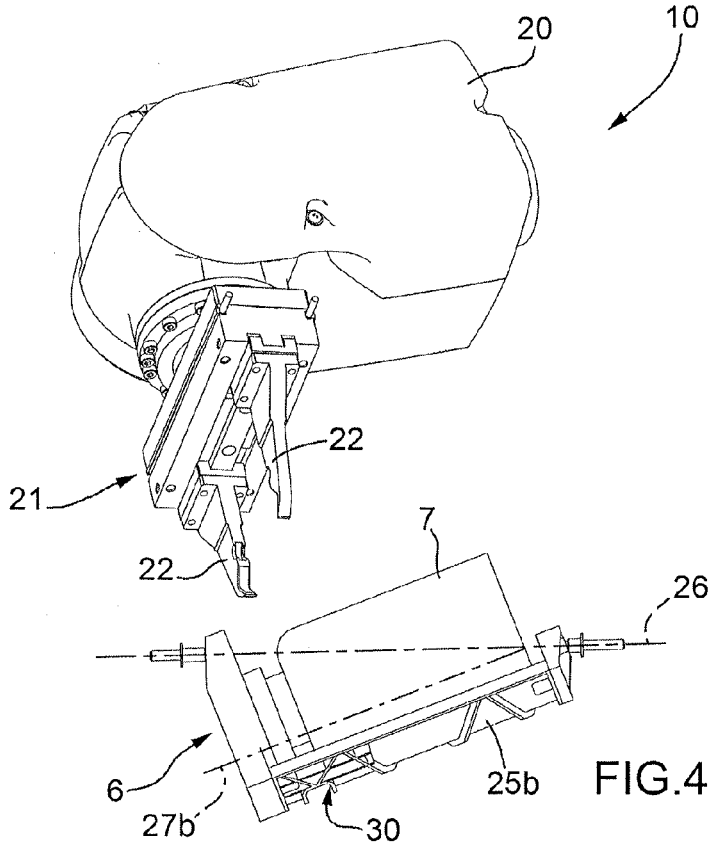
FIG. 4 is a diagrammatic perspective view, with parts removed for clarity, of a second detail of the machine in FIG. 1.

As shown in FIGS. 1, 3, and 4, the device 10 is mounted within the store 8, comprises a plurality of jointed arms 20 hinged to one another, and provided with a gripping arm 21, which is mounted on the free end of the arms 20, and is defined by two jaws 22 mobile between a clamping position and a releasing position of a syringe 5 or a bottle 7.

Figure 2:
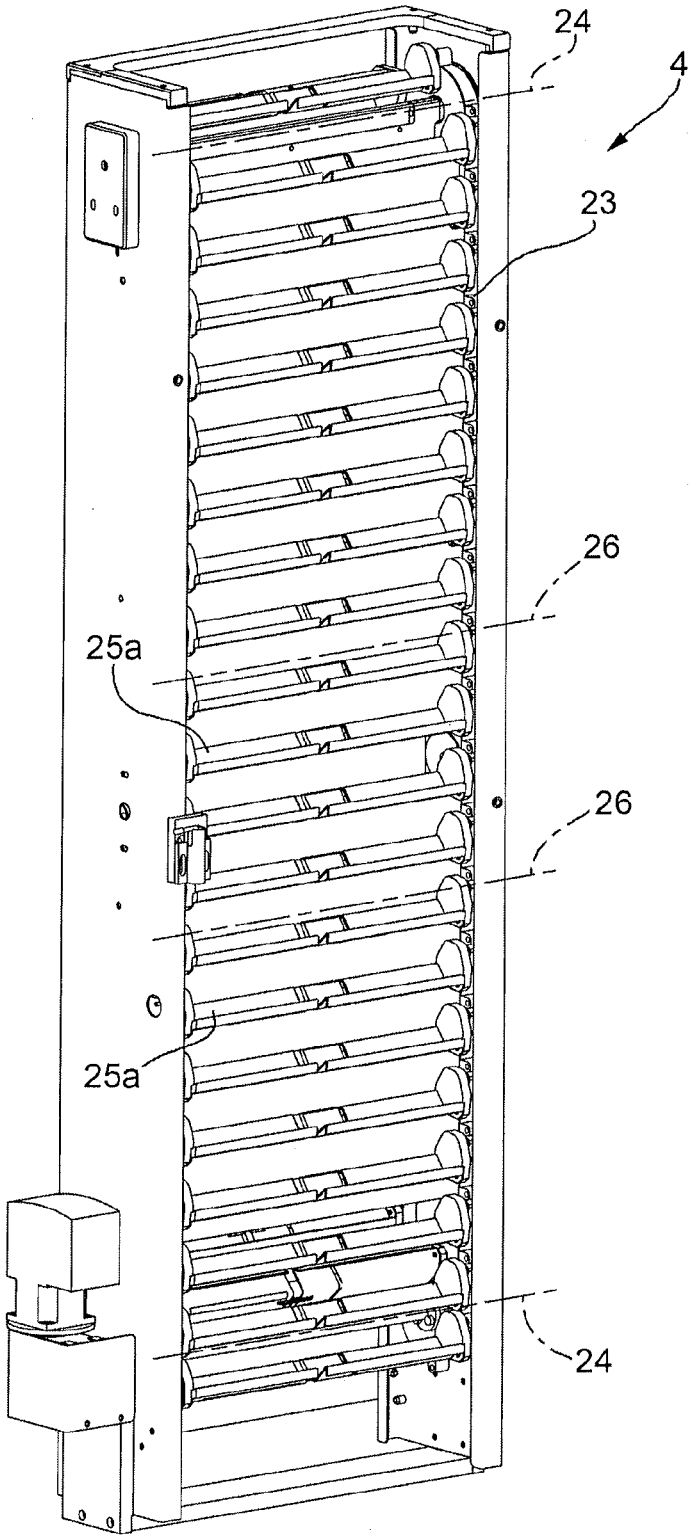
FIG. 2 is a diagrammatic perspective view, with parts removed for clarity, of a first detail of the machine in FIG. 1.

With reference to FIG. 2, each store 4, 6 comprises two reciprocally parallel belt conveyors 23, each of which extends in a substantially vertical direction A, faces the other conveyor 23, and is looped about a pair of pulleys (not shown), which are coaxial with the pulleys (not shown) of the other conveyor 23, and are mounted so as to intermittently rotate about respective rotation axis 24 parallel to one another and transversal to direction A.

Each store 4, 6 further comprises a plurality of transport cradles 25, which extend between the conveyors 23, are coupled to the conveyors 23 to oscillate, with respect to conveyors 23, about respective axes 26 with fulcrum parallel to one another and to axes 24, and which are uniformly distributed along the conveyors 23 themselves.

As shown in FIG. 3, each cradle 25 of the store 4 (hereinafter indicated by numeral 25*a*) has a substantially V-shaped transversal section, is arranged with an axis 27*a* thereof parallel to axes 24, 26, is provided with a first slot 28 adapted to receive the flange 13 of a syringe 5 to guarantee the correct longitudinal positioning of the syringe 5 in the cradle 25*a*, and further has a second slot 29 adapted to be engaged by the jaws 22 to allow the device 10 to pick the syringe 5 from the cradle 25*a* itself.

With reference to FIG. 4, each cradle 25 of the store 6 (hereinafter indicated by numeral 25*b*) has a substantially V-shaped transversal section, is arranged with a longitudinal axis thereof 27*b* inclined with respect to axis 24, 26, and is provided with a slot 30, which is obtained near the lower end of the cradle 25*b*, allows to correctly position a bottle 7 with its concavity facing downwards, and allows the jaws 22 to pick the bottle 7 itself.

Each store 4, 6 extends through a loading station obtained through the frame 2 to allow the operator to load the syringes 5 or bottles 7 into the respective cradles 25*a*, 25*b*, and through a single picking station, where the syringes 5 or the bottles 7 are picked from the respective cradles 25*a*, 25*b* by the device 10, and for this reason the device 10 is relatively simple and cost-effective. Furthermore, the loading and unloading of the syringes 5 and of the bottles 7 in, and respectively from, the respective cradles 25*a*, 25*b* does not require the machine 1 to be stopped at all.

Figure 6:
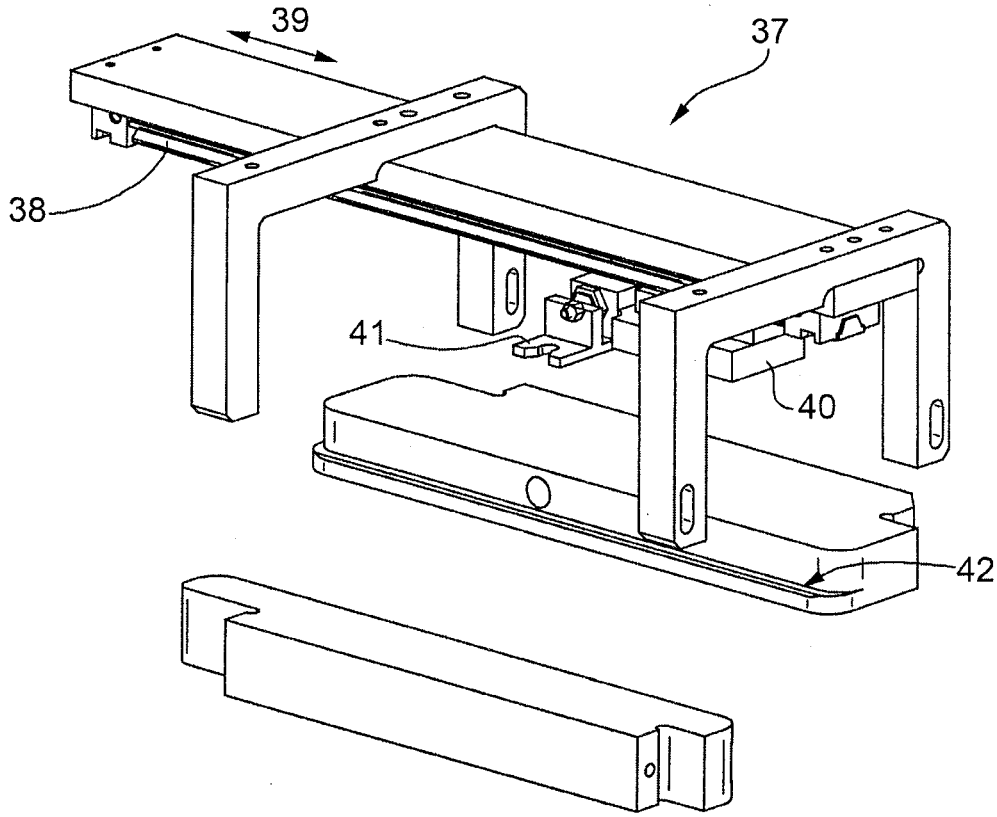
FIG. 6 is a diagrammatic perspective view, with parts removed for clarity, of a detail in FIG. 5.

As shown in FIGS. 5 and 6, the store 8 comprises an annular, star-shaped wheel 31, which extends about the device 10, is mounted to rotate intermittently, with respect to the frame 2 and under the bias of an actuating device (known and not shown), about a substantially vertical rotation axis 32, and has a plurality of pockets 33, which are obtained along a peripheral edge of the wheel 31, open radially outwards and are each adapted to receive and withhold a respective infusion bag 9.

The pockets 33 are fed by the wheel 31 about axis 32 and along a circular path P extending through a loading and unloading station 34 of the bags 8 into, and respectively from, the store 8, a weighing station 35 of the bags 9, and a dosing station 36 for injecting a predetermined amount of pharmaceutical into the bags 9 themselves.

Each station 34, 35, 36 is provided with a linear transfer device 37 comprising a rectilinear guide 38 parallel to a horizontal direction 39 transversal to axis 32, a slide 40 slidingly coupled to the guide 38 to perform rectilinear movements along the guide 38 in direction 39, and a gripping fork 41 slidingly coupled to a slide 40 to move, with respect to the slide 40 and transversally to direction 39, between a coupling position and a releasing position of the pin 19 of a respective adapter member 17.

The device 37 from station 34 cooperates with a guide 42, which is parallel to the respective guide 38, is radially aligned with the pocket 33 arranged each time in station 34 to be slidingly engaged by the member 17 of a respective pocket 9, and extends between the store 8 and an opening 43 obtained through the frame 2 to allow an operator to load the bags 9 on the guide 42 and to pick the bags 9 from the guide 42 itself.

Figure 7A:
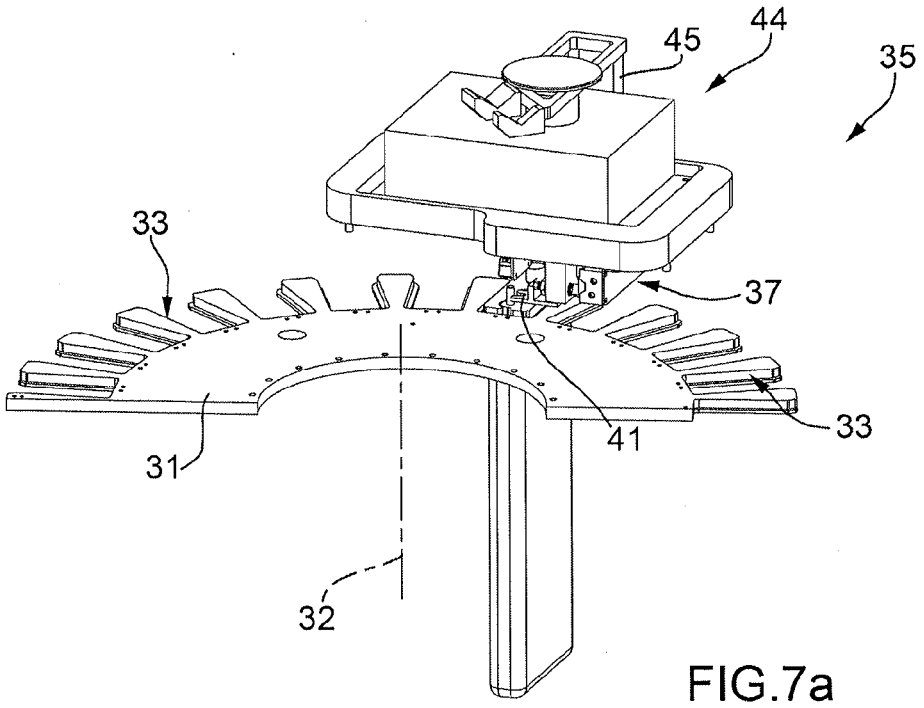
FIG. 7*a* is a diagrammatic perspective view, with parts removed for clarity, of a fourth detail of the machine in FIG. 1.
Figure 7B:
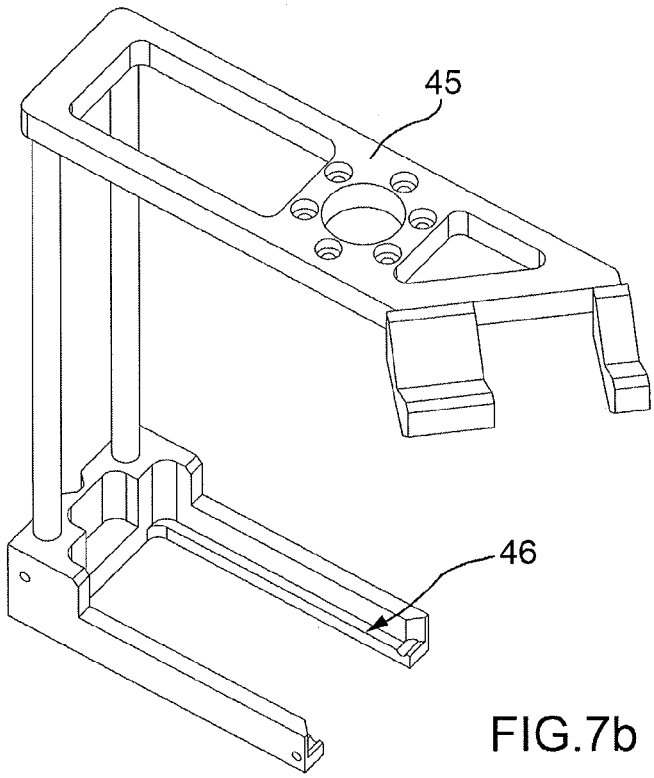
FIG. 7*b* is a perspective view of a detail in FIG. 7*a;*

With reference to FIGS. 7*a* and 7*b*, device 37 of station 35 cooperates with a weighing device 44 comprising a supporting mobile member 45, which is coupled in known manner to a fixed part of the device 44 to move vertically under the weight of the bags 9, is fork-shaped and defines a guide 46 radially aligned with the pocket 33 arranged on each time in station 35 to be slidingly engaged by the member 17 of a respective bag 9.

The device 37 of station 36 cooperates with a guide (not shown), which is parallel to the respective guide 38, is radially aligned with the pocket 33 arranged each time in station 36 to be slidingly engaged by the member 17 of a respective bag 9, and is adapted to stop the bag 9 itself underneath a syringe 5, which is transferred from the device 10 between the store 4 and a gripping and actuating assembly 47 of the syringe 5 itself.

Figure 8:
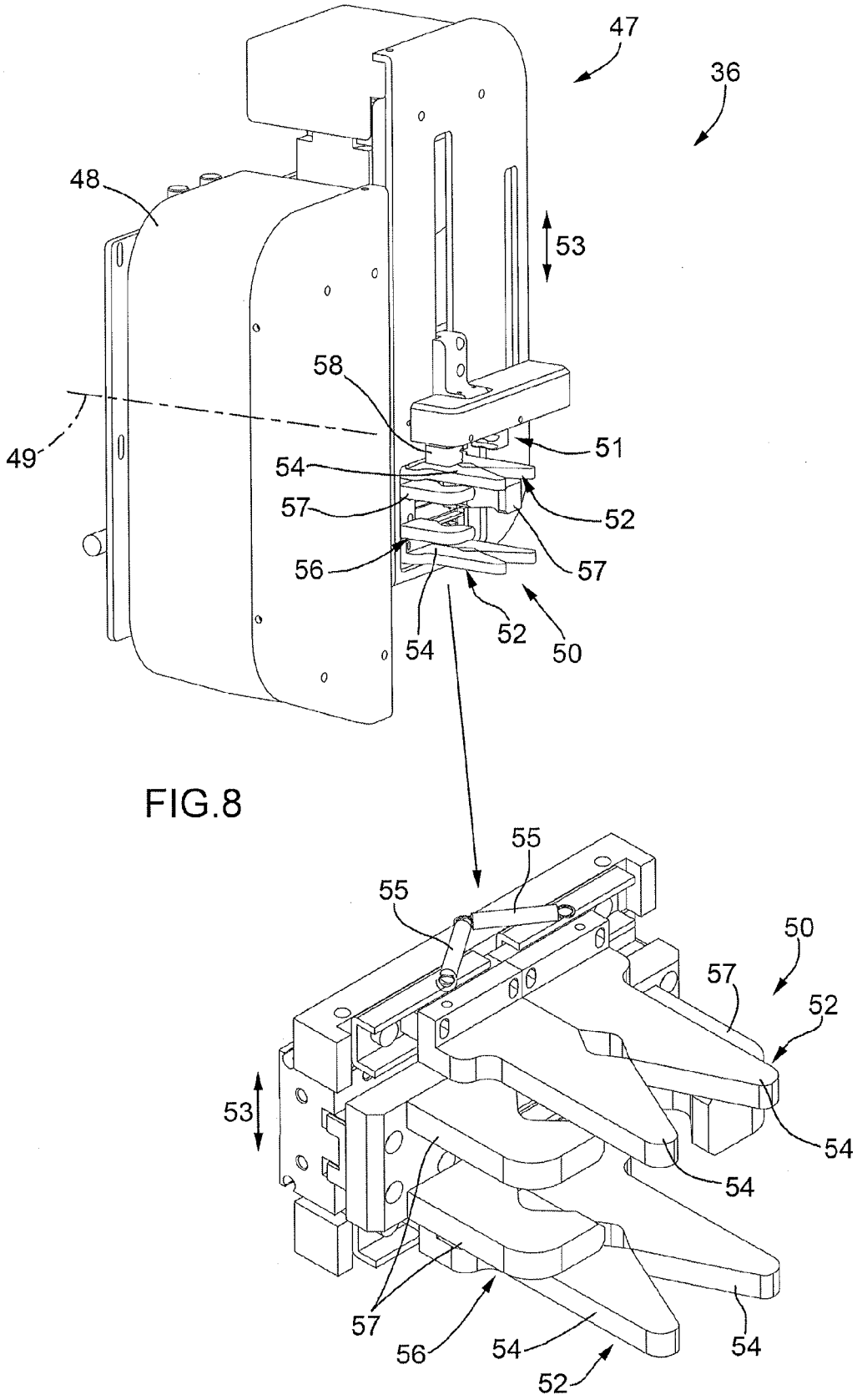
FIG. 8 is a schematic perspective view, with parts enlarged and parts removed for clarity, of a fifth detail of the machine in FIG. 1.
Figure 9:
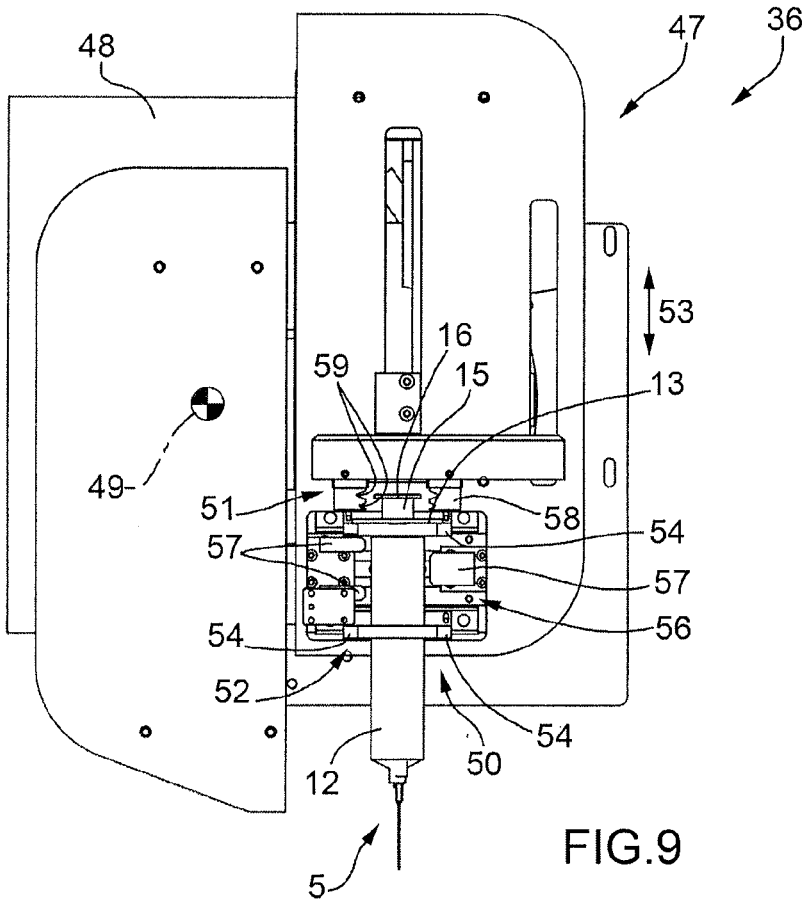
FIG. 9 is a diagrammatic front view, with parts removed for clarity, of the detail in FIG. 8.

As shown in FIGS. 8 and 9, the assembly 47 comprises a supporting block 48, which is mounted to rotate about a horizontal rotation axis 49 transversal to axis 32, and supports a gripping device 50 of the cylinder 12 and a gripping device 51 of the piston 15.

The device 50 comprises two grippers 52, which are reciprocally aligned in a direction 53, the orientation of which depends on the position of the block 48 about axis 49, and each comprise two respective jaws 54, which are slidingly coupled to the block 48 to move, with respect to the block 48 itself, transversally to direction 53, and are normally maintained in a clamping position of the cylinder 12 by respective springs 55 arranged between the block 48 and the jaws 54 and loaded so as to allow the axial movement of the syringe 5 through the grippers 52.

The device 50 further comprises an intermediate gripper 56, which extends between the grippers 52, and comprises, in turn, two jaws 57 slidingly coupled to the block 48 to move with respect to the block 48 and under the bias of an actuating device (known and not shown), transversally to direction 53 between a clamping position and a releasing position of the cylinder 12 of a syringe 5.

With regards to the above, it is worth noting that the jaws 57 are shaped so as to allow one of the jaws 57 to be inserted inside the other jaw 57 and also to clamp syringes 5 of relatively small diameter.

The device 51 comprises two jaws 58, which are slidingly coupled to the block 48 to move with respect to the block 48 and under the bias of an actuating device (known and not shown), transversally to direction 53 between a clamping position and a releasing position of the head 16 of a syringe 5, and are further slidingly coupled to the block 48 to perform rectilinear movements in direction 53 itself with respect to the block 48 and under the bias of an actuating device (known and not shown). Each jaw 58 has a plurality of grooves 59 (two grooves 59, in the case in point) superimposed on one another in direction 53 to allow the device 51 to receive and withhold the heads 16 of syringes 5 of different size.

The operation of the assembly 47 will now be described starting from an instant in which the jaws 57 and the jaws 58 are arranged in their releasing positions and the syringe 5 is inserted by the device 10 within the jaws 54 against the bias of the springs 55.

Once the syringe 5 is inserted within the grippers 52, the jaws 58 are firstly closed over the head 16 and then lowered in direction 53 so as to move the syringe 5 through the grippers 52, arrange the flange 13 in contact with the upper jaw 52 and, possibly, push the piston 15 fully into the cylinder 12.

The operating sequence shown above allows to correctly position the syringe 5 in direction 53 and guarantees a correct, constant positioning of all syringe 5 regardless of the size thereof, of the initial position of the pistons 15 along the respective cylinders 12, and of the axial, initial angular positions of the syringes 5 in the grippers 52.

Finally, the jaws 57 are moved from the clamping position of syringe 5 within the assembly 47, and the jaws 58 are moved to their clamping position of the head 16 to control the movement of piston 15 during the steps of aspirating and injecting the pharmaceutical.

Figure 10:
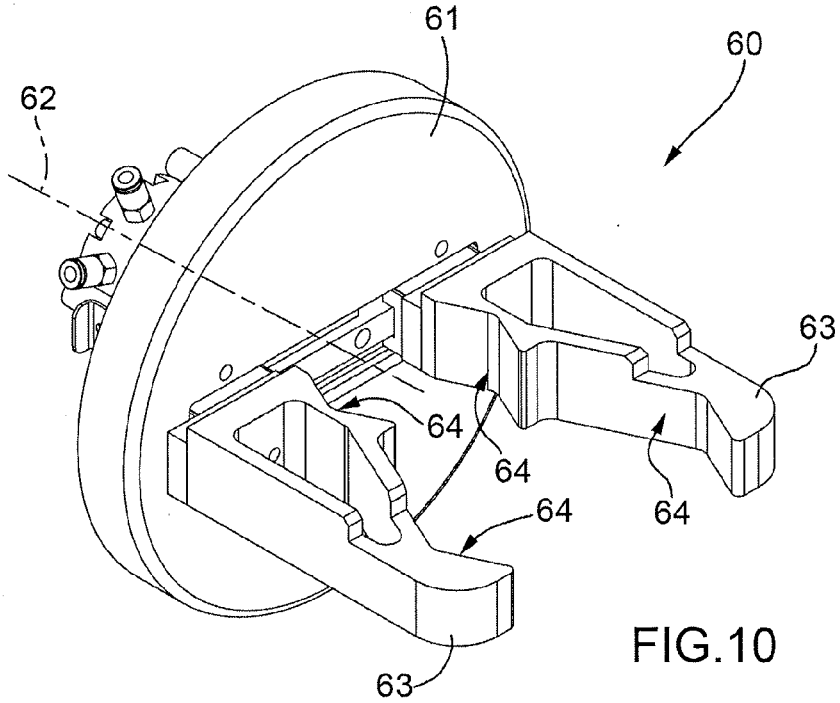
FIG. 10 is a diagrammatic perspective view, with parts removed for clarity, of a sixth detail of the machine in FIG. 1.

With reference to FIG. 10, the machine 1 further comprises a mixer device 60 for mixing a lyophilized or powder pharmaceutical and a diluent contained in a bottle 7 to one another.

The device 60 comprises a rotating plate 61, which is mounted to alternatively rotate about a substantially horizontal rotation axis 62, and is provided with a pair of jaws 63 coupled in known manner to the plate 61 to move, with respect to the plate 61, transversally to the axis 62, between a clamping position and a releasing position of a bottle 7. Each jaw 63 is shaped so as to display, in the case in point, a pair of seats 64, which cooperate with corresponding seats 64 of the other jaw 63 to allow the jaws 63 to withhold bottles 7 of different size.

Figure 11:
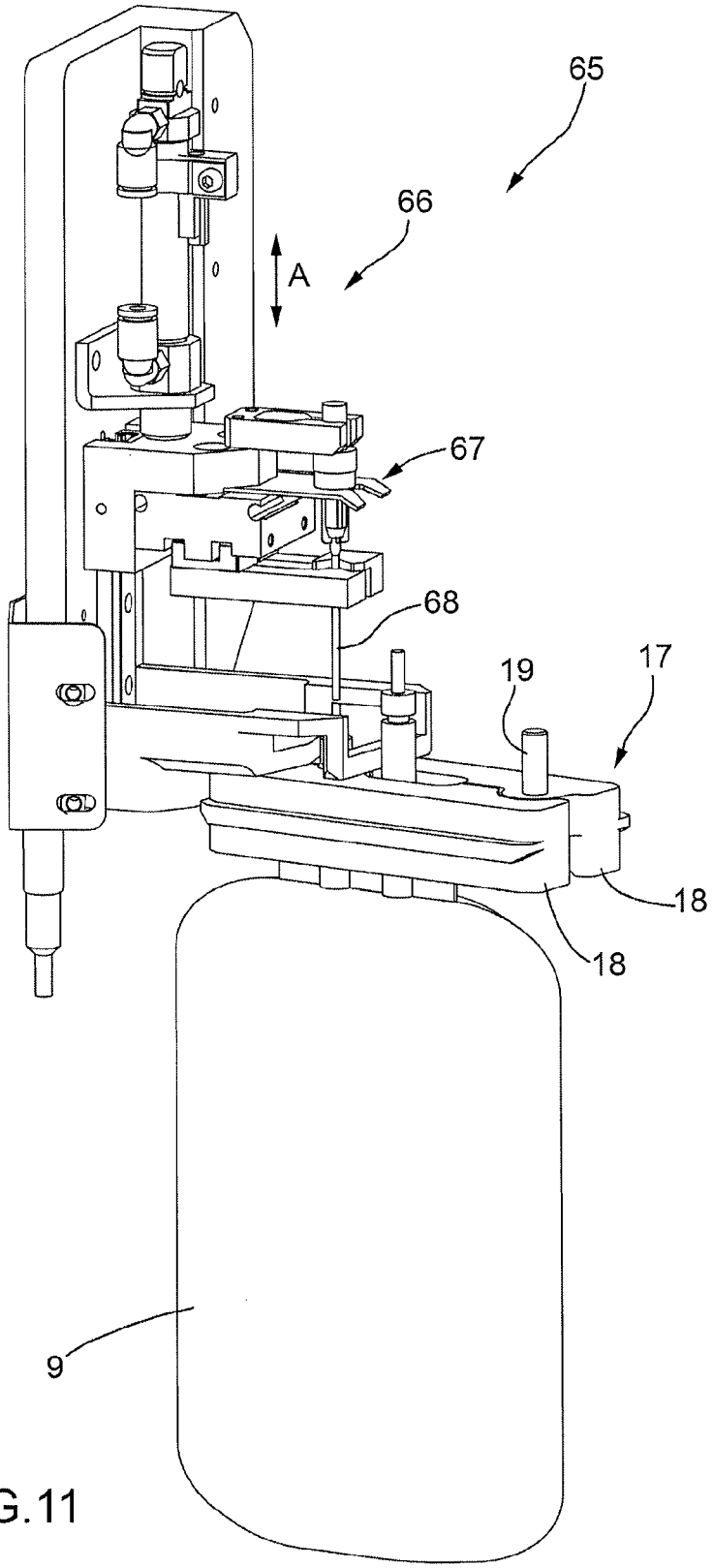
FIG. 11 is a diagrammatic perspective view, with parts removed for clarity, of a seventh detail of the machine in FIG. 1.
Figure 12:
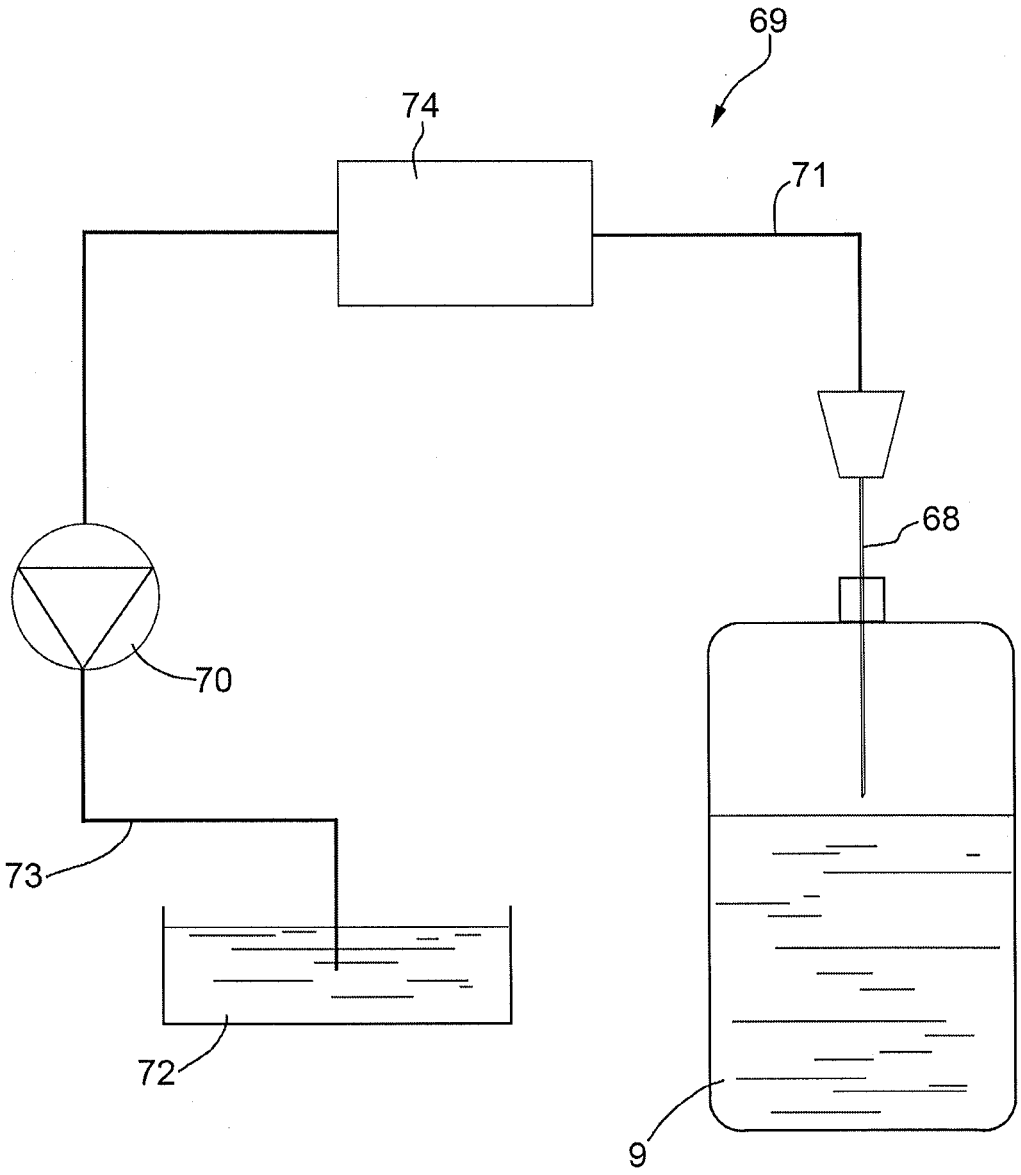
FIG. 12 diagrammatically shows the operating principle of the detail in FIG. 11.

As shown in FIGS. 11 and 12, the path P further extends through a picking station 65 of a predetermined amount of liquid from the bags 9. The picking of the liquid of bag 9 is necessary when the total weight of the pharmaceutical and of the diluent contained in the bag 9 after having injected the pharmaceutical needs to be equal to a determined value lower than the weight of the diluent initially contained in the bag 9 itself alone.

The station 65 has an aspiration assembly 66 comprising a gripping device 67 adapted to receive and withhold an extraction needle 68, which is connected to a hydraulic aspiration circuit 69, is transferred by the device 10 in the device 67 after having been separated from a protective cap thereof (known and not shown), and is moved by the device 67 in direction A between a raised resting position, in which the needle 68 is arranged outside the bag 9, and a lowered operating position, in which the needle 68 protrudes within the bag 9 over the diluent contained in the bag 9 itself.

The circuit 69 comprises an extraction pump 70, a peristaltic pump in the case in point, having an inlet hydraulically connected to the needle 68 by means of a first pipe 71, and an outlet hydraulically connected to a collection reservoir 72 of the diluent picked from the bags 9 by means of a second pipe 73.

The bags 9 contain a determined amount of air, and for this reason the pipe 71 is provided with a flow sensor 74, a capacitance sensor in the case in point, which allows to discriminate between the passage of air and of liquid along the pipe 71, and thus correctly calculate the volume of liquid aspirated from the bags 9 by means of the pump 70. In other words, the volume of liquid aspirated from the bags 9 is calculated only starting from the instant in which the sensor 74 detects the passage of liquid along the pipe 71.

Figure 13B:
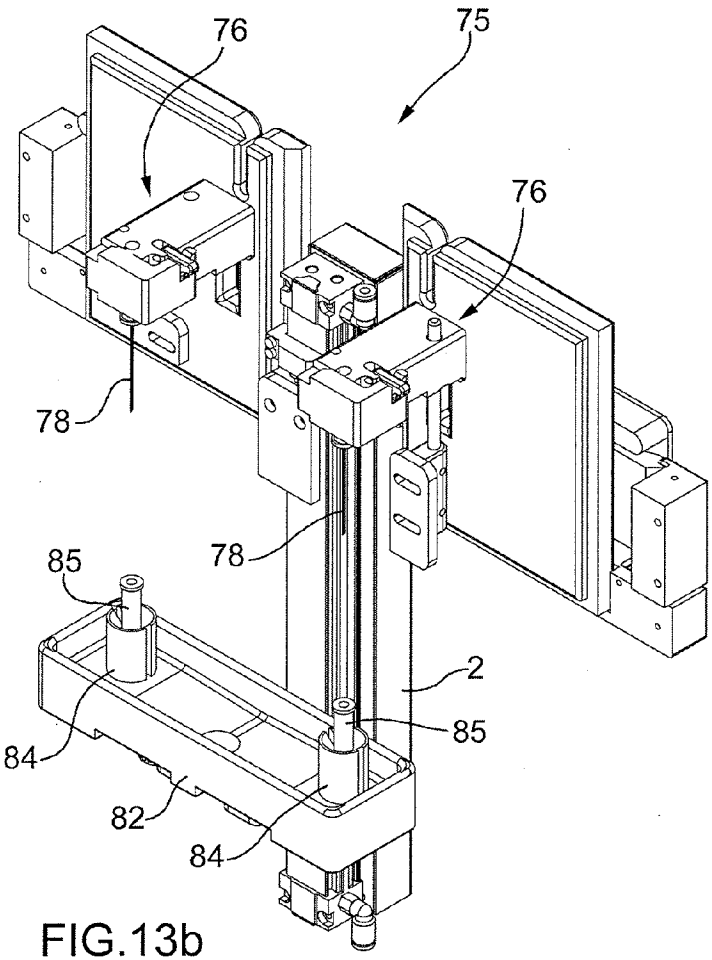
FIGS. 13*a* and 13*b* are a diagrammatic perspective views, with parts removed for clarity of an eighth detail of the system in FIG. 1 shown in two different operating positions.
Figure 13A:
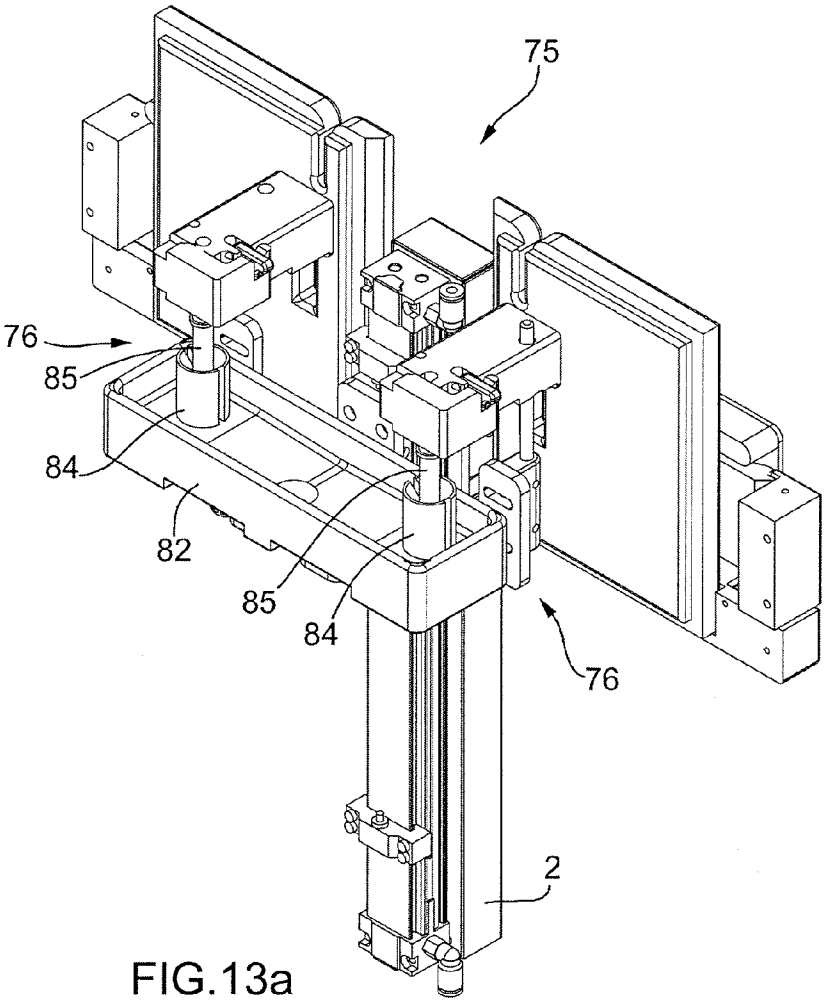
Figure 14:
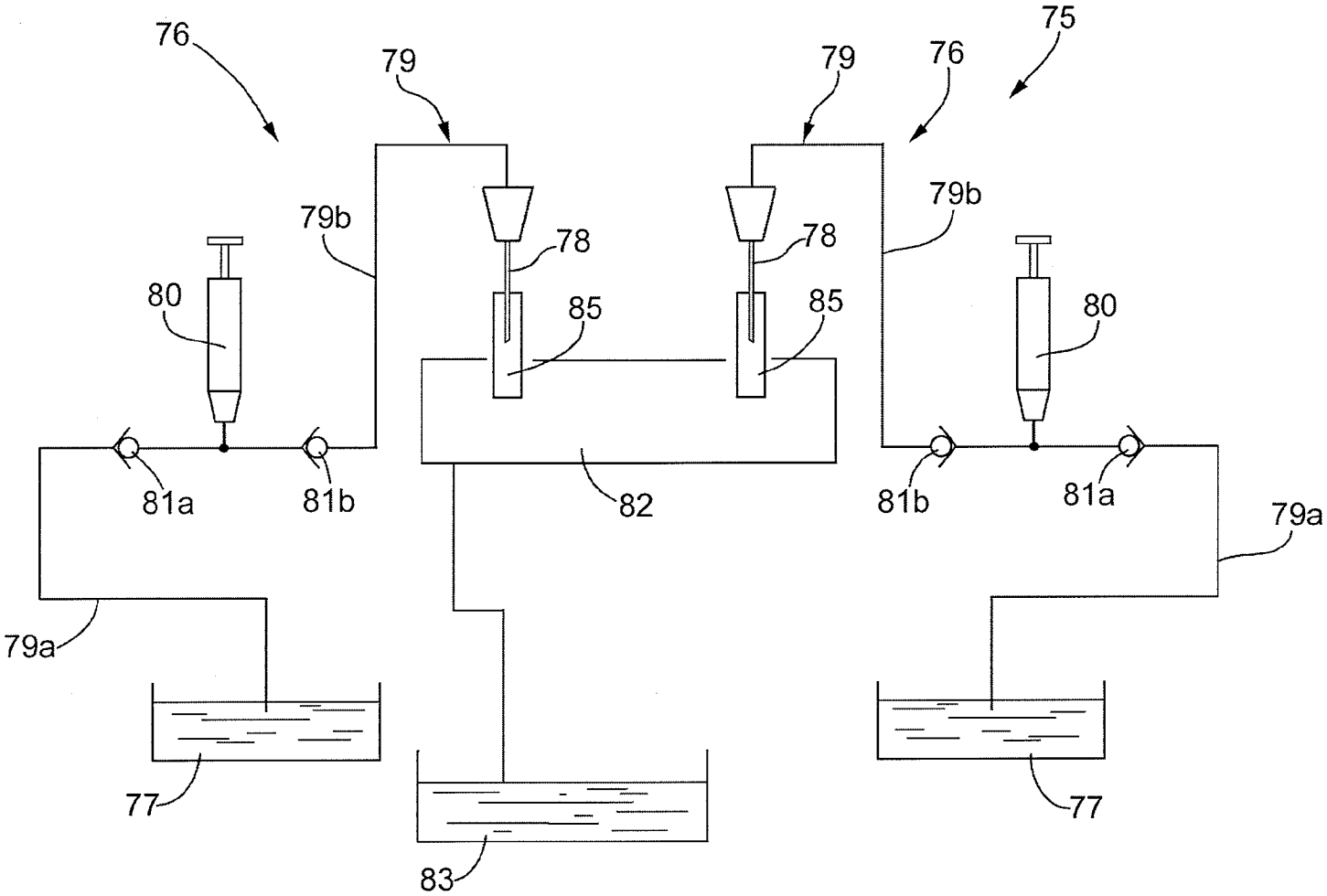
FIG. 14 diagrammatically shows the operating principle of the detail in FIGS. 13*a* and 13*b*.

With reference to FIGS. 13 and 14, the machine 1 further comprises a feeding device 75 for feeding a diluent into a bottle 7 containing a lyophilized or powder pharmaceutical.

The device 75 comprises feeding assemblies 76, two in the case in point, each of which comprises, in turn, a feeding reservoir 77 (e.g. a bag 9) for the diluent; a feeding needle 78 coupled to the frame 2 and hydraulically connected to the reservoir 77 by means of a pipe 79; and a pumping device defined, in the case in point, by a syringe 80, which is connected to an intermediate point of the pipe 79, and is actuated in known manner to aspirate a predetermined amount of diluent from the reservoir 77 and to feed the diluent itself into the bottle 7.

The connection between the pipe 79 and the syringe 80 divides the pipe 79 into two segments 79*a*, 79*b*, which are arranged in sequence and in this order between the reservoir 77 and the needle 78, and which are provided with respective check valves 81*a*, 81*b*, of which valve 81*a* avoids the flow back of diluent into segment 79*a* when diluent is fed to the needle 78, and valve 81*b* avoids the flow back of diluent from segment 79*b* when the diluent is aspirated from the reservoir 77.

The device 75 further comprises a collection reservoir 82, which extends underneath the needles 78, is coupled in known manner to the frame 2 to move with respect to the frame 2, in direction A between a lowered resting position (FIG. 13*b*) and an operating raised position (FIG. 13*a*), and is hydraulically connected to a collection manifold 83 of the diluent. The reservoir 82 further displays a pair of tubes 84, each of which protrudes upwards from a bottom wall of the reservoir 82, is substantially coaxial to the respective needle 78, and accommodates therein a protective cap 85 of the needle 78 itself arranged in the tube 84 with the concavity facing upwards.

In use, the reservoir 82 is moved, with the caps 85 of the needles 78, to its lowered resting position to allow inserting two bottles 7 underneath the needles 78 and feeding the diluent into the bottles 7 themselves.

When they are extracted from the respective bottles 7 the bottles may have residues of the lyophilized or powder pharmaceutical, and for this reason at the end of each injection operating cycle of the feeding device 75, the reservoir 82 is moved into its raised operating position so as to fit the caps 85 on the respective needles 78, and the syringes 80 are actuated to allow to wash the needles 78 with the diluent contained in the reservoirs 77.

The diluent fed through the needles 78 flows firstly into the respective caps 85 and thus into the reservoir 82 and into the manifold 83. With this regard, it is worth noting that:

the amount of diluent used to wash the needles 78 also allows to wash the caps 85;

the caps 85 are, like the needles 78, initially sterile and may therefore be used to wash the respective needles 78 at the end of each programmed injection operating cycles in a working session of the machine 1; and the conclusion of the working session of the machine 1 requires only the replacement of needles 78 and of the respective caps 85 and does not require the sterilization of the reservoir 82.

Figure 15:
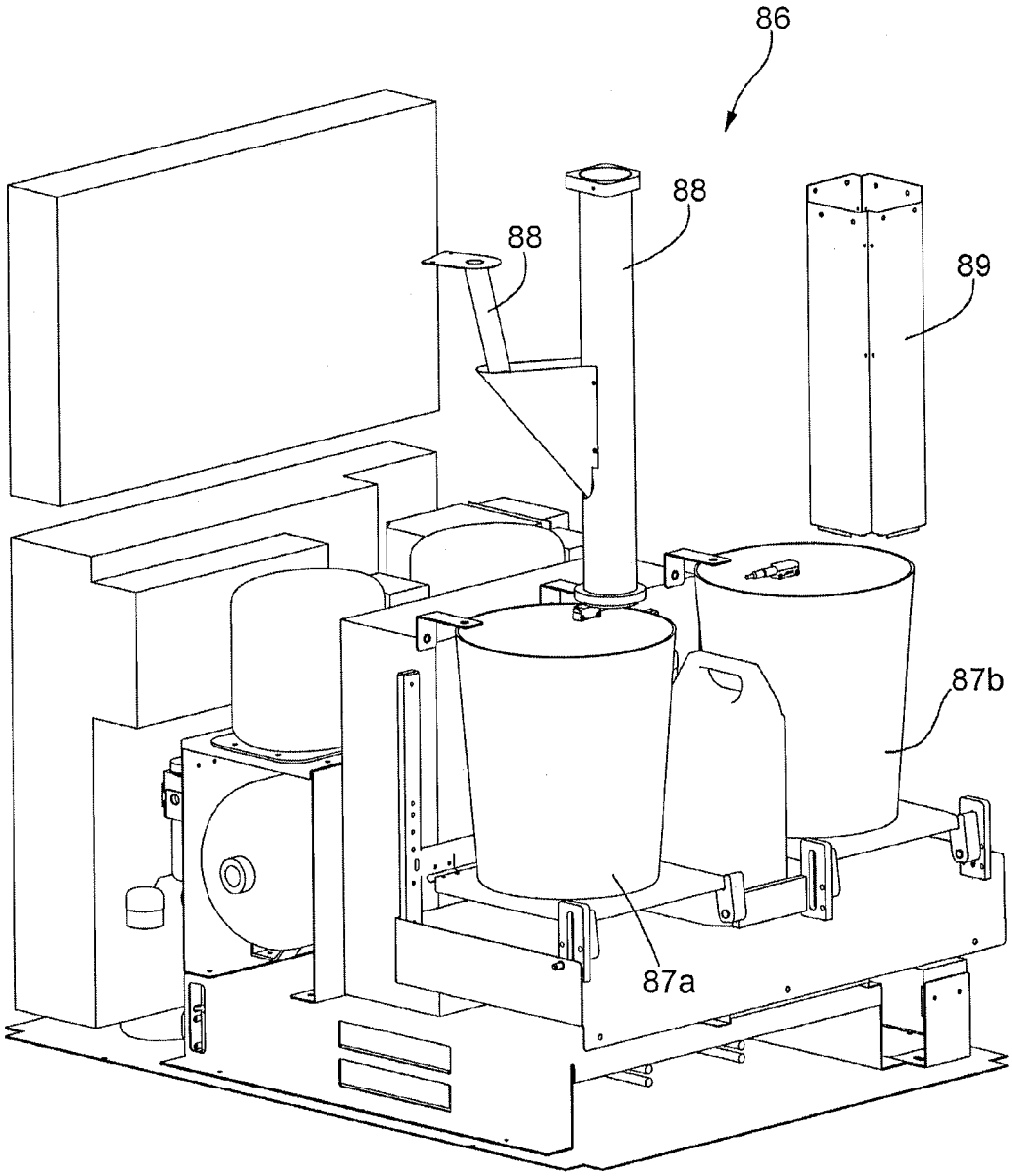
FIG. 15 is a diagrammatic perspective view, with parts removed for clarity, of a ninth detail of the machine in FIG. 1.

As shown in FIG. 15, the machine 1 is further provided with a collection device 86 of the processing waste (e.g. syringes 5, bottle 7, needles 78, and caps 85) accommodated within the frame 2 underneath the store 8, and comprising, in the case in point, two collection containers 87, of which one (hereinafter indicated by numeral 87*a*) communicates with the chamber 3 by means of a pair of slides 88 and the other (hereinafter indicated by numeral 87*b*) communicates with the chamber 3 itself by means of one chute only 89.

In use, the various processing waste is selectively fed by the device 10 to the various chutes 88, 89 and, thus, to the various containers 87*a*, 87*b*, thus allowing to separate the processing waste.

The operation of the machine 1 is easily inferred from the description above and no further explanations are required.

The invention claimed is:

1. An assembly for actuating a syringe including a cylinder, an outer flange and a piston slidingly engaged in the cylinder, the assembly comprising:

a first gripping device configured and dimensioned to engage the cylinder of the syringe, the first gripping device including at least one gripper;

a second gripping device configured and dimensioned to engage the piston of the syringe and to translate the syringe through the at least one gripper;

an intermediate gripper configured and dimensioned to engage the cylinder of the syringe, the intermediate gripper including a pair of jaws; and an actuating device configured to move the pair of jaws of the intermediate gripper transversely to the longitudinal axis of the syringe between a clamping position and a releasing position, wherein the pair of jaws of the intermediate gripper are in the releasing position when the syringe is translated through the at least one gripper, wherein the pair of jaws of the intermediate gripper are in the clamping position after the syringe is translated through the at least one gripper, wherein the first gripping device and the second gripping device are translatable with respect to one another in a direction parallel to a longitudinal axis of the syringe, and wherein translating the syringe through the at least one gripper includes at least one of (i) translating the outer flange into contact with the at least one gripper, and (ii) fully translating the piston into the cylinder.

2. The assembly according to claim 1, wherein the first gripping device further comprises elastic pushing means to maintain the at least one gripper in a clamping position relative to the cylinder.

3. The assembly according to claim 1, wherein the pair of jaws of the intermediate gripper includes a first jaw that is configured and dimensioned to receive a second jaw.

4. The assembly according to claim 3, wherein the first jaw includes two spaced jaw members and wherein the second jaw includes one interlocking jaw member facing the two spaced jaw members.

5. The assembly according to claim 1, wherein the at least one gripper of the first gripping device includes a first gripper and a second gripper, and wherein the intermediate gripper is positioned between the first gripper and the second gripper.

6. The assembly according to claim 1, wherein the second gripping device comprises a pair of second gripper jaws adapted to actuate between a first gripper clamping position and a second gripper releasing position relative to an end head defined by the piston.

7. The assembly according to claim 6, wherein the pair of second gripper jaws comprises a plurality of grooves configured and dimensioned to accommodate a variety of sizes of the end head.

8. The assembly according to claim 6, wherein the pair of second gripper jaws is translatable with respect to the at least one gripper in the direction parallel to the longitudinal axis of the syringe to translate the syringe through the at least one gripper, and wherein translating the pair of second gripper jaws at least one of (i) translates the outer flange into contact with the at least one gripper, and (ii) fully translates the piston into the cylinder.

9. A method for actuating a syringe including a cylinder, an outer flange and a piston slidingly engaged in the cylinder, the method comprising:

providing an assembly for actuating the syringe, the assembly including (i) a first gripping device configured and dimensioned to engage the cylinder of the syringe, the first gripping device including at least one gripper, (ii) a second gripping device configured and dimensioned to engage the piston of the syringe and to translate the syringe through the at least one gripper, (iii) an intermediate gripper configured and dimensioned to engage the cylinder of the syringe, the intermediate gripper including a pair of jaws; and (iv) an actuating device configured to move the pair of jaws of the intermediate gripper transversely relative to the longitudinal axis of the syringe between a clamping position and a releasing position, wherein the pair of jaws of the intermediate gripper are in the releasing position when the syringe is translated through the at least one gripper, wherein the pair of jaws of the intermediate gripper are in the clamping position after the syringe is translated through the at least one gripper, wherein the first gripping device and the second gripping device are translatable with respect to one another in a direction parallel to a longitudinal axis of the syringe, and inserting the syringe into the at least one gripper; and translating the syringe through the at least one gripper; wherein translating the syringe through the at least one gripper includes at least one of (i) translating the outer flange into contact with the at least one gripper, and (ii) fully translating the piston into the cylinder.

10. The method according to claim 9, further comprising maintaining the at least one gripper in a clamping position relative to the cylinder by elastic pushing means.

11. The method according to claim 9, further comprising actuating the pair of jaws of the intermediate gripper between the clamping position and the releasing position.

12. The method according to claim 9, wherein the second gripping device comprises a pair of second gripper jaws adapted to actuate between a clamping position and a releasing position relative to an end head defined by the piston.

13. The method according to claim 12, wherein the pair of second gripper jaws is translatable with respect to the at least one gripper in the direction parallel to the longitudinal axis of the syringe to translate the syringe through the at least one gripper.

14. The method according to claim 13, further comprising:

translating the pair of second gripper jaws into contact with the end head defined by the piston; and translating the pair of second gripper jaws in the direction parallel to the longitudinal axis of the syringe to translate the syringe through the at least one gripper, wherein translating the pair of jaws of the second gripping device includes at least one of (i) translating the outer flange into contact with the at least one gripper, and (ii) fully translating the piston into the cylinder.

15. The method according to claim 14, further comprising:

actuating the pair of second gripper jaws into a clamping position relative to the end head; and translating the pair of second gripper jaws in the direction parallel to the longitudinal axis of the syringe to actuate the syringe.

16. The method according to claim 15, wherein translating the pair of second gripper jaws controls movement of the piston within the cylinder.

17. The method according to claim 9, wherein the pair of jaws of the intermediate gripper includes a first jaw and a second jaw, the first jaw being configured and dimensioned to receive the second jaw.

18. The method according to claim 17, wherein the first jaw includes two spaced jaws and wherein the second jaw includes one interlocking jaw facing the two spaced jaws.

* * * * *